US005900282A

United States Patent [19]

Collins et al.

[11] Patent Number: 5,900,282

[45] Date of Patent: May 4, 1999

[54] METHOD OF DEPOSITING A DIELECTRIC ONTO ELECTRICALLY CONDUCTIVE ELEMENTS

[75] Inventors: David Robert Collins, Southgate; Paul Earl Pergande, Melvindale; Matthew John Zaluzec, Canton; Armando Mateo Joaquin, Rochester Hills; Jeffrey Alan Kinane, Birmingham, all of Mich.

[73] Assignee: Ford Global Tech nologies, Inc., Dearborn, Mich.

[21] Appl. No.: 09/009,511

[22] Filed: Jan. 20, 1998

[51] Int. Cl.[6] ..... B05D 1/08

[52] U.S. Cl. ..... 427/447; 427/446

[58] Field of Search ..... 427/446, 447

[56] References Cited

U.S. PATENT DOCUMENTS

| | | | |
|---|---|---|---|
| 2,958,609 | 11/1960 | Stoll et al. | 427/447 |
| 3,947,617 | 3/1976 | Gerek et al. . | |
| 3,962,486 | 6/1976 | Gerek et al. . | |
| 4,835,022 | 5/1989 | Huhne . | |
| 5,108,825 | 4/1992 | Wojnarowski et al. | 428/209 |
| 5,197,892 | 3/1993 | Yoshizawa et al. . | |
| 5,236,551 | 8/1993 | Pan | 156/643 |
| 5,278,442 | 1/1994 | Prinz et al. . | |

*Primary Examiner*—Katherine A. Bareford
*Attorney, Agent, or Firm*—Joseph W. Malleck

[57] ABSTRACT

A method of depositing a dielectric coating, comprising the steps of forming an unroughened or roughened, as-cast or wrought substrate surface to receive the coatings; and flame spraying a single premixed thermoplastic epoxy/hardener powder onto the surface, the resultant in-flight heated powder being chemically activated to impact the surface and form a chemically adhering coating, the coating being cured in-situ to be dielectric and thermally conductive.

8 Claims, 2 Drawing Sheets

METHOD OF DEPOSITING A DIELECTRIC ONTO ELECTRICALLY CONDUCTIVE ELEMENTS

BACKGROUND OF THE INVENTION

1. Technical Field

This invention relates to the technology of electrically isolating electrically functioning elements, and more particularly to an improved process for depositing electrically insulating thermoplastic coatings onto an unroughened or roughened substrate by flame spraying or equivalent spraying that cures the coating immediately.

2. Discussion of the Prior Art

Ceramic coatings are often used to electrically isolate elements in an assembly, such as isolating an alternator diode plate from high current in an adjacent member in an automotive alternator. In an automotive alternator, a rectifier employs negative and positive diode plates to convert A.C. current to D.C. These plates need to be electrically isolated but allow for thermal conductivity therebetween. Aluminum oxide is a typical ceramic candidate that is used for these coatings; it is usually applied in a four step process, comprising; (i) roughening a plate surface by grit blasting to receive the coating, (ii) masking parts of the surface (usually with consumable hardened steel) that do not receive the coating, (iii) using an argon/hydrogen plasma spraying process to melt and deposit a powder supply of $Al_2O_3$, and (iv) sealing the porosity of the ceramic coating with an ultraviolet curable plastic overcoat. This process is costly and the ceramic is difficult to machine once deposited. It is also complex, requiring separate processing steps for roughening, masking, spraying and sealing which maybe unnecessary. The process limits certain physical characteristics of the coating to less than desirable bond strength, corrosion resistance and machineability.

Although flame sprayed epoxy coatings have not been used as dielectric coatings, they have been deployed for corrosion resistance and cosmetic applications. For such other applications, epoxy powders are usually applied by traditional powder coating processes such as electrostatic spraying followed by curing in an oven for a given time to fully activate and cure the epoxy. The art of applying epoxy by flame spray techniques has depended on the use of separate supplies of epoxide resin and hardener and has limited the type of resins that can be used because in-flight heating may not be effective to activate and cure the epoxy properly. Thus, the prior art has usually turned to plasma guns for depositing epoxy because they tend to increase or promote activation. Flame spraying has never been used to deposit epoxy coatings for electrical isolation, and when epoxy has been thermally sprayed, the powder material has not been cured in-situ as a direct result of thermal spraying.

SUMMARY OF THE INVENTION

It is an object of this invention to provide a method of depositing an electrically insulating thermoplastic epoxy coating by use of flame spraying that in-situ activates and cures the epoxy during flight to the target, and impacts the target with such chemically activated epoxy to achieve enhanced bond strength thereto.

It is also an object of this invention to provide a method of depositing an electrically insulating thermoplastic epoxy coating that envelopes or buries electrical wires or traces on a plastic electrical-insulating support member to simplify assembly and protect electrical wiring.

The invention that meets the above objects is a method of depositing a dielectric coating, comprising the steps of: (a) forming a cast, molded, wrought or machined substrate surface to receive the coatings; and (b) flame spraying a single premixed thermoplastic epoxy/hardener powder onto the surface, the resultant in-flight heated powder being chemically activated to impact said surface and form a chemically adhering coating, the coating being at least partially cured in-situ to be functionally dielectric and thermally conductive.

The substrate surface may be a plastic molded non-conductive support member; the epoxy resins may be selected from the group of epichlorohydrin, and functional equivalents; and the hardener maybe selected from the group of bisphenol A. and triglycidyl isocyanurate.

DETAILED DESCRIPTION AND BEST MODE

Figure 1:
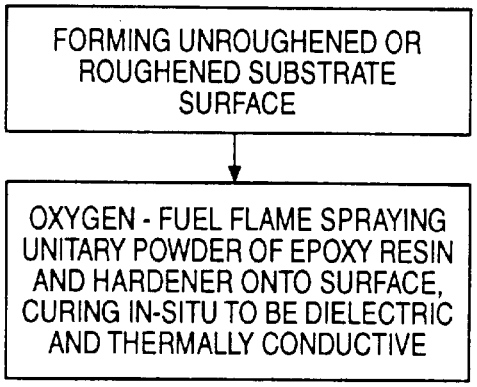
FIG. 1 is a block diagram of the steps of this invention.
Figure 2:
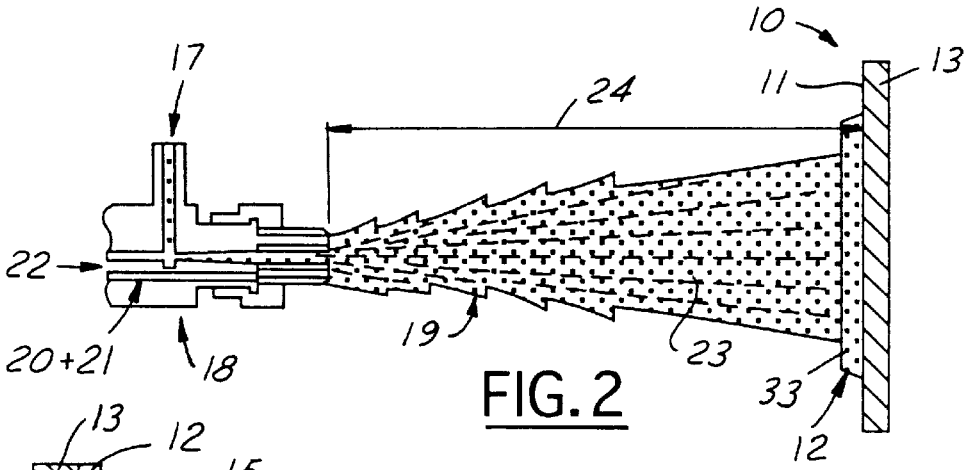
FIG. 2 is a schematic illustration of the flame spraying technique used to apply a unitary powder consisting of epoxy resin and hardener, in accordance with this invention.
Figure 4:
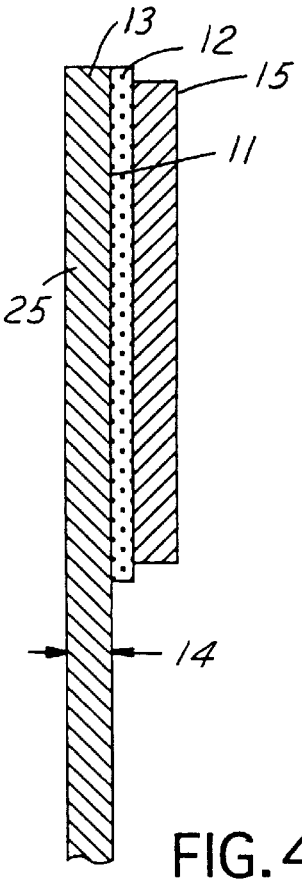
FIG. 4 is an enlarged schematic edge view of a portion of two dielectric plates forming part of an alternator assembly and showing how the dielectric coating functions with such diode plates.
Figure 3C:
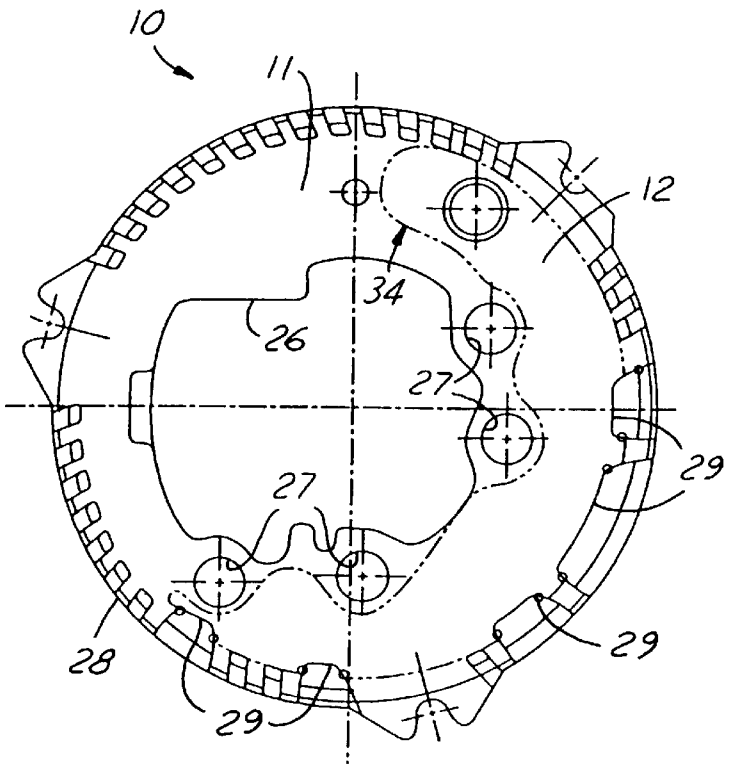
FIGS. 3*a,* 3*b* and 3*c* are respectively an edge elevational view of an automotive alternator negative diode plate, a left side view and a right side view all illustrating reception of a functional epoxy coating on a surface of the plate by the spray technique of FIG. 2.
Figure 3A:
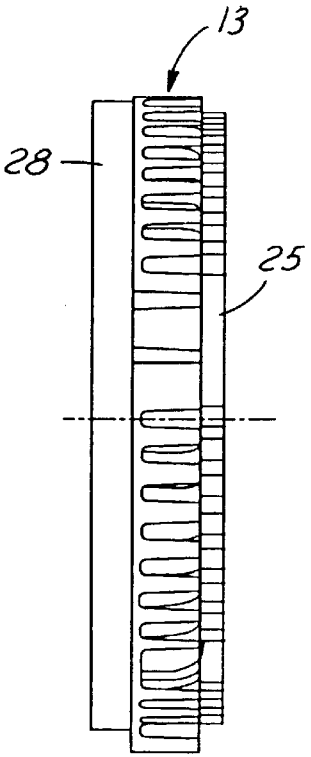
Figure 3B:
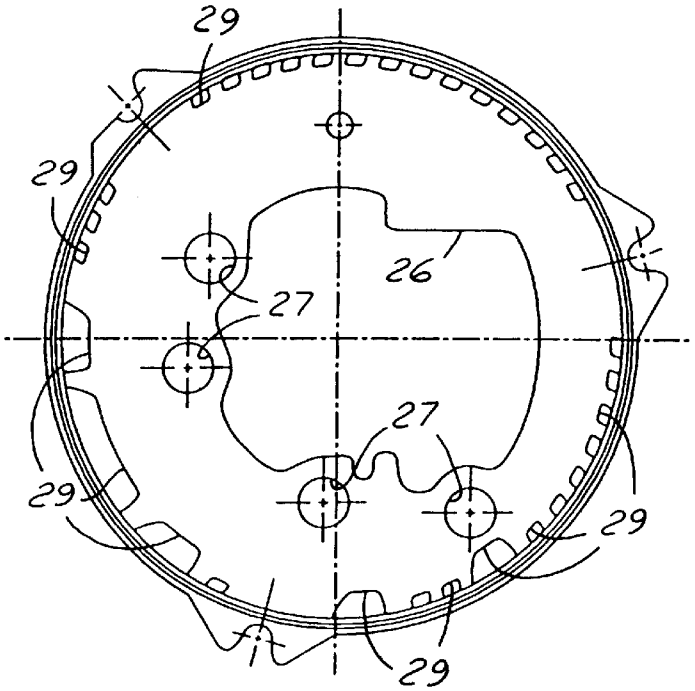

The method of this invention, in it most elementary form, comprises essentially two steps as shown in FIG. 1. First, an unroughened or roughened, as-cast, molded or wrought metallic or plastic substrate 10 is formed with a surface 11 to receive a coating 12. If metallic, the substrate 10 is electrically conductive and, if used to carry current, must be isolated. If plastic, electrical conductors attached thereto may need to be supported thereon in an isolated manner. For example, the substrate may be an alternator negative diode plate 13 (as shown in FIGS. 3*a,* 3*b,* 3*c* and 4) comprised of diecast aluminum in an as-cast condition. The plate 13 may have a thickness 14 of about 0.13 inches, although the use of this invention is independent of plate thickness. The plate 13 is designed to provide an electrically and thermally conductive path for the alternator. Another diode plate 15 is electrically isolated from plate 13 by the dielectric coating 12. Dielectric coating 12 provides a thermally conductive path between diode plate 15 and plate 13, but electrically isolates such plates.

The negative diode plate 13 as shown, has a flat wall 25 carrying surface 11; wall 25 has (i) several cut out portions 26, 27, (ii) an annular cylindrical wall 28 extending to one side of wall 25, and (iii) more cut portions 29 intersecting the flat wall periphery and cylindrical wall 28. The coating can be deposited in a zone, outlined at 34, or may be deposited across the entire surface wall 25.

Next, the surface is flame sprayed with a single powder supply 17 consisting of pre-mixed or pre-agglomerated grains of epoxide resin and hardener. Each grain of the powder contains both an epoxide resin and hardener which, when activated by sufficient heat, becomes chemically active to begin to cure. Time and temperature ratios are dependent on the specific epoxy and blend used, but for epichlorohydrin resin and bisphenol A hardener, the temperature of activation is about 350° F. with further heating achieving self-curing. The powder is at least 50% cured in flight for proper adhesion and dielectric performance. The powder continues to cure after deposition for several seconds because it is further heated by subsequent added layers 33 during deposition. The substrate may also be preheated to speed cure time. Preheat temperature, flame temperature (determined by oxy fuel ratio and flow rates) and powder feed rates are determined based on the time and temperature cure chart provided for each selected powder. The powder supply desirably has an average particle size of about 20–100 microns.

The temperature of activation is achieved by use of a flame spray gun 18 that projects a flame 19 from a burning flow of oxygen 20 and fuel 21, the flame being at a temperature of about 4000° F. Compressed air 22 (at 30–90 psi) is typically directed to the point at which the powder 17 is introduced to the flame 19 to aspirate powder into the flame. This projects the melted powder particles 23 across distance 24 about 4–8 inches for optimal deposition rates and reasonable cure times. Thus, the single powder supply 17 is fed into such flame to be enveloped and projected therefrom onto the surface. Particle velocity, as a result of the compressed air and flame, will be in the range of 50–100 feet per second. The powder is thus heated to a temperature which melts the powder and triggers a chemical reaction which not only converts the powder into a fluid, but partially or completely polymerizes the molten epoxy particles in-flight to the target substrate; thus there is no need for a post furnace curing step. The deposition rate for such technique is low, usually in the range of 1–10 kg hr, and thus, this process is effective for thin coatings (i.e. 0.010 inch). Thin coatings promote thermal conductivity therethrough, such as 10–15 w/mk. The fluidity of the thermoplastic is self-leveling on the target surface and is highly adherent, creating a surface bond between 500 and 2,500 psi. This bond is due primarily to mechanical bonding of the coating to the substrate. When cooled, the thermoplastic coating will have a glossy texture similar to bakelite. Porosity is less than 1% by volume. The gun may be reciprocated to repetitively coat the surface with one or more passes to build a desired coating thickness. The thermal spray step takes no longer than 45 seconds to deposit the coating and coat a typical alternator housing.

The two part epoxy powder grains are comprised of an epoxide resin preferably epichlorohydrin, (which can function as a dielectric and provide electrical isolation), and a hardener preferably selected from the group of bisphenol A, triglycidyl isocyanurate, and functional equivalents. Dielectric is used herein to mean a material which provides electrical isolation such as a dielectric strength of 1000 volts A.C. and 500 volts D.C. for a 0.005–0.006 inch coating. Additives may be advantageously premixed in each powder grain, to increase thermal conductivity while retaining the dielectric property, (i.e. $TiO_2$, $Al_2O_3$). Catalysts facilitate in-flight curing and may be added to the powder grains. Most color tinting ingredients should be avoided to maintain optimum dielectric properties.

This two step process herein offers several advantages: it is low in cost and high in speed because roughening, masking, post furnace curing and sealing steps can be eliminated. Compared to plasma sprayed ceramic dielectric coatings, the processing cost can be reduced to less than ¼ thereof. Compared to electrostatic spraying of thermoset powders at room temperature, the cost can be reduced to ⅓ thereof. The process is surprisingly effective because it has found that (a) a single pre-mixed thermoplastic epoxy/hardener powder can be activated and cured in-situ by the act of thermal spraying and (b) the thermally projected epoxy has unusally strong adherency to metallic or plastic substrates.

Figure 5:
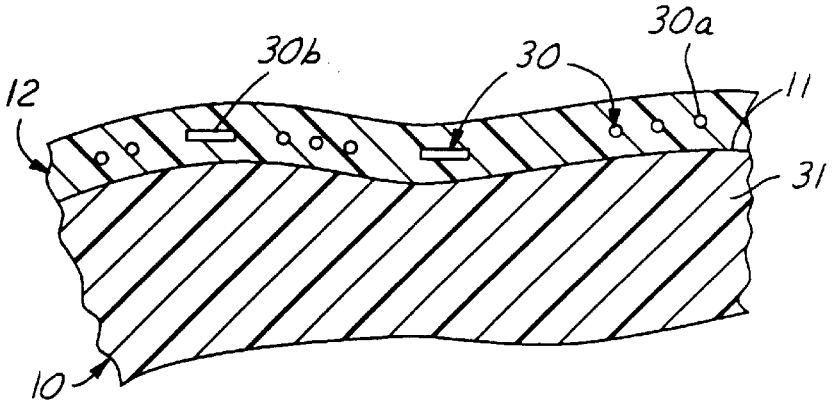
FIG. 5 is a highly enlarged schematic sectional elevational view of a plastic support member having adhered thereto an epoxy coating with electrical traces or wires buried therein in accordance with this invention.

An another example of the flexibility and utility of the process herein, FIG. 5 illustrates how it offers the opportunity to create buried electrically conductive wires or traces 30 on a plastic component 31. The coating electrically isolates such wires while providing a support that promotes complete freedom of design and ease of packaging and assembly. As shown in FIG. 5, the wires 30*a* or metal traces 30*b* can be layed directly on the plastic substrate or suspended close to the substrate plastic surface; the thermoplastic coating 12 is applied onto the surface and around the wires or traces to embed such. To ensure that the wire or trace placement is accurate, the spraying process may observe certain precautions such as not overheating the substrate during preheat, not overheating the substrate during the coating application, making the spraying passes quick and frequent rather than slow and few, and ensuring chemical compatibility between the coating and substrate before the coating is applied.

Applications of embedded metal conductive wires on plastic members is useful for automotive climate control systems, air distribution systems, electronic housings, and electrical distribution systems, using plastic substrates or housings. Unlike the traditional "spray and bake" process where the entire component must be subjected to a furnace cure (making the process incompatible with many plastic housings), the flame spray process minimizes heat input into the plastic housing by depositing a premelted epoxy coating directly onto the plastic to automatically surround the suspended wires. This alternative process has a potential to reduce manufacturing costs for wiring harnesses by burying wire traces to plastic housings which can both simplify the assembly process and reduce weight by minimizing the amount of wire that is used in the wiring harness.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of this invention.

We claim:

1. A method of depositing a dielectric coating, comprising the steps:

(a) forming an unroughened or roughened, as-cast, molded, wrought or machined substrate surface to receive the coating, and (b) flame spraying, by oxy-fuel flame, a premixed thermoplastic epoxy/hardener powder onto said surface, said powder having grains comprised of an epoxide resin of epichlorohydrin and a hardener selected from the group consisting of bisphenol A and triglycidyl isocyanurate, the resultant in-flight heated powder being chemically activated to form a chemically adhering coating, said coating being at least partially cured in-situ to be functionally dielectric and thermally conductive, said powder grains having one or more catalysts to facilitate at least 50% in-situ curing during in-flight heating.

2. A method of depositing a dielectric coating, comprising the steps:

(a) forming an unroughened or roughened substrate as an alternator diode plate comprised of an as-cast diecast aluminum surface to receive the coating, and (b) flame spraying a premixed thermoplastic epoxy/hardener powder onto said surface, the resultant in-flight heated powder being chemically activated to form a chemically adhering coating, said coating being at least partially cured in-situ to be functionally dielectric and thermally conductive.

3. The method as in claim 2, in which said powder is devoid of electrically conductive ingredients and has a specific gravity of about 1.2–1.35.

4. The method as in claim 2, in which the deposited coating has a thickness of 0.006–0.008 inches and is self-leveling.

5. The method as in claim 2, in which said powder has an average particle size of 20–100 microns.

6. The method as in claim 2, in which the resulting coating has a bond strength adhering to said substrate of 500–10,000 psi.

7. A method of depositing a dielectric coating, comprising the steps:

(a) forming a substrate surface to receive the coating with electrical conductors superimposed on or suspended close to the substrate during flame spraying of step (b), said substrate being a non-conductive plastic, and (b) flame spraying a premixed thermoplastic epoxy/hardener powder onto said surface, the resultant in-flight heated powder being chemically activated to form a chemically adhering coating that is burying said electrical conductors in said coating as deposited, said coating being at least partially cured in-situ to be functionally dielectric and thermally conductive.

8. The method as in claim 7, in which said substrate is a climate control housing element for an automobile.

* * * * *